United States Patent [19]

De Giulio

[11] Patent Number: 4,993,786

[45] Date of Patent: Feb. 19, 1991

[54] METHOD AND APPARATUS FOR RETROFITTING A DRAWER WITH A MULTIPLE LEVEL STORAGE TRAY

[76] Inventor: John P. De Giulio, 5915 Da Costa, Dearborn Heights, Mich. 48127

[21] Appl. No.: 344,813

[22] Filed: Apr. 28, 1989

[51] Int. Cl.[5] ..... A47B 88/22

[52] U.S. Cl. ..... 312/298; 312/301; 211/70.7; 211/162

[58] Field of Search ..... 312/298, 301, 308; 211/162, 151, 70.7

[56] References Cited

U.S. PATENT DOCUMENTS

| | | | |
|---|---|---|---|
| 128,439 | 6/1872 | Unna | 312/301 |
| 362,544 | 5/1887 | Holmes | 312/301 |
| 1,061,646 | 5/1913 | Welliver | 312/301 |
| 2,425,232 | 8/1947 | Earle | 62/89 |
| 2,471,529 | 5/1949 | Barre | 312/301 |
| 2,574,099 | 11/1951 | Gessler | 211/70.7 |
| 2,711,944 | 6/1955 | Meek et al. | 312/301 |
| 2,825,617 | 3/1958 | Morgan | 211/162 |
| 3,278,248 | 10/1966 | Torok | 312/308 |
| 4,570,804 | 2/1986 | Meenan | 211/126 |
| 4,895,417 | 1/1990 | Rock | 312/330.1 |

FOREIGN PATENT DOCUMENTS

| | | | |
|---|---|---|---|
| 533985 | 12/1954 | Belgium | 312/301 |
| 269758 | 11/1950 | Switzerland | 312/301 |
| 838374 | 6/1960 | United Kingdom | 312/308 |

OTHER PUBLICATIONS

Photographs of Siematic Mobelwerke Device, three (3) pages from the SieMatic Catalog, 1984.

*Primary Examiner*—Laurie K. Cranmer
*Assistant Examiner*—Brian K. Green
*Attorney, Agent, or Firm*—Brooks & Kushman

[57] ABSTRACT

A storage apparatus (10) for converting a standard drawer (12) into a multiple level drawer having a stationary base tray (24) and a shiftable upper tray (26). The base tray (24) is secured to the front of the drawer (12) and includes laterally extending filler flanges (44, 46) on right and left sides of the base tray (24). The upper tray (26) is detachably secured to a support panel (54). Roller and track assemblies (30, 32) interconnect the support panel (54) of the upper tray (26) to the base tray (24). The upper tray (26) is shifted until it extends through an opening (76) formed in the rear wall (18) of the drawer (12). The roller and track assembly (30, 32) preferably includes channels (60) secured to the upstanding walls (34, 36) of the bottom tray (24) and bearing members (62) secured to the channels (60). According to the method of the present invention, the storage apparatus is retrofitted to a standard drawer which is modified by removing a cut-out from the rear wall of the drawer. The base tray (24) is secured to the modified drawer and the upper tray (26) is attached for horizontal shifting to the base tray (24). The method also includes molding the base tray (24) and upper tray (26).

14 Claims, 2 Drawing Sheets

METHOD AND APPARATUS FOR RETROFITTING A DRAWER WITH A MULTIPLE LEVEL STORAGE TRAY

TECHNICAL FIELD

The present invention relates to a compartmentalized storage device for kitchen utensils or other small articles stored in drawers. More particularly, the present invention relates to a kit for converting a standard drawer into a double drawer having two storage trays, one of which is shiftable relative to the other storage tray.

BACKGROUND

Kitchen utensils, medical supplies, dental tools and other small articles are stored in special partitioned drawers which permit separation of small articles while stored in the drawer. In many instances, it is desirable to increase the number of compartments within a drawer.

Molded utensil trays having compartments for kitchen utensils or other small objects are conventionally placed loosely in the bottom of a drawer. In some instances, it is desirable to have even more compartments to increase the available number of compartmentalized storage sections in a drawer.

One approach to this problem is shown in a product catalog published by SieMatic Mobelwerke GmbH & Co. (SieMatic) at page 77, wherein specialized original equipment drawers having a slidable utensil tray are disclosed. The specialized drawer has a slidable tray which is built into the sides of the drawer. The sides of the drawer have milled slots extending from front to rear at an intermediate height on the inside wall of the drawer. The slidable tray has extensions on both sides which fit into the milled slot. The SieMatic drawer is well suited for drawers of new cabinet systems, but it is not well suited for retrofitting to existing drawers due to the difficulty of forming the guide slots in the sides of previously assembled drawers. In addition, assembly of the slidable tray to a standard drawer would be fairly complicated.

The milled slots in the sides of the drawers may create substantial friction which would resist easy movement of the tray slide. It is also not easily adapted for retrofit into different width drawers as would be essential to a simple and effective retrofit kit.

It is an object of the present invention to provide a multiple level compartmentalized storage tray which is suitable for retrofit to a wide range of drawer sizes.

Another object of the present invention is to provide a multiple level storage tray having a upper storage tray which is easily slidable in drawer guides between a closed position above a base tray slide and an open position wherein the upper tray slide is cantilevered through an opening in the back wall of the drawer.

An object of the present invention is to provide a multiple tiered drawer insert kit for retrofit in a standard drawer to increase the storage capacity of the drawer which is not difficult to install and does not require specialized tools for installation.

Another object of the present invention is to provide a two-tiered compartmentalized storage tray having an upper storage tray which is biased to the closed position as the drawer is opened.

These and other problems and disadvantages are overcome and the above objects are achieved by the present invention as will be more fully described below.

SUMMARY OF THE INVENTION

The present invention relates to a retrofit storage apparatus for a drawer wherein a base tray is secured to the drawer and an upper tray is slidably interconnected to the base tray which is movable from a closed position to an open position. The upper tray and base tray are interconnected by means for guiding the horizontal shifting of the upper tray from the closed position in which the upper tray is vertically directly above the base tray to an open position in which the upper tray is cantilevered rearwardly and above the base tray to extend horizontally through a cutout formed in the rear wall of the drawer.

More particularly, the present invention relates to a two-tiered storage apparatus for retrofit to a conventional drawer. The storage apparatus includes a base tray having a compartmentalized storage section. A lip extends substantially horizontally and outwardly from the compartmentalized storage section. The lip has an outer edge located at distance from the compartmentalized storage section from which a vertical wall extends upwardly. Lateral trim flanges are connected to an upper edge of the vertical wall to extend substantially horizontally and outwardly and are cut to fit the side walls of the drawer. An upper tray is disposed above the base tray and includes a support panel. A compartmentalized storage receptacle is detachably secured to the support panel. A roller track means is connected to the upper tray and the base tray for guiding the horizontal shifting movement of the upper tray from a closed position in which the upper tray is vertically directly above the base tray to an open position in which the upper tray is cantilevered by the roller track means rearwardly and above the base tray. In the open position, the upper tray extends horizontally through the cutout and partially behind the rear wall of the drawer.

An important aspect of the storage apparatus of the present invention relates to the concept of providing trim flanges on the lateral sides of the compartmentalized storage section of the lower tray. The trim flanges fill between the compartmentalized storage section and the side walls of the drawer and are trimmed to fit a given drawer width. The compartmentalized storage receptacle is preferably detachably secured to the support panel so that it may be removed for cleaning or for carrying as a tray.

The upper and base trays are interconnected by means of roller and track assemblies connected to adjacent portions of the upper tray and base tray. A pair of roller and track assemblies are preferably provided with a pair of base tray channels being secured to each lateral side of the base tray. The base tray channels each include a first bearing member at the rear thereof. A pair of upper tray channels are secured on each lateral side of the upper tray. Each upper tray channel has a second bearing member located at the front end of the channel. The bearing members ride upon a roller engaging surface of the channel to which it is not connected.

The roller engaging surfaces of the upper tray channels preferably include raised sections which bias the upper tray into the closed position as the drawer is opened. After opening, the upper tray may be easily moved past the raised section to have access to the lower tray compartmentalized storage section.

The method of the present invention relates to retrofitting a conventional drawer with a two-tiered compartmentalized storage tray. The method includes the steps of removing an upper portion of a rear wall of the drawer to form an opening in the rear wall. A base tray having a first part of a track and roller assembly is secured to the drawer by fastening means. An upper tray is then attached by a second part of the track and roller assembly to the first part of the track and roller assembly retained on the base tray. The upper tray is then horizontally shiftable and guided by the track and roller assembly between a closed position and an open position.

Another aspect of the method of the present invention is the step of attaching a compartmentalized storage section to a support panel. The support panel is preferably first attached to the base tray before the assembly of the compartmentalized storage section to the support panel.

According to the method of the present invention, the base tray is first molded in one piece. A first part of the track roller assembly is then secured to the molded base tray. The compartmentalized storage section of the upper tray is likewise molded in one piece. The second part of the track and roller assembly is then secured to the support panel.

The present invention will be more fully described below in reference to the attached drawing.

DETAILED DESCRIPTION

Figure 1:
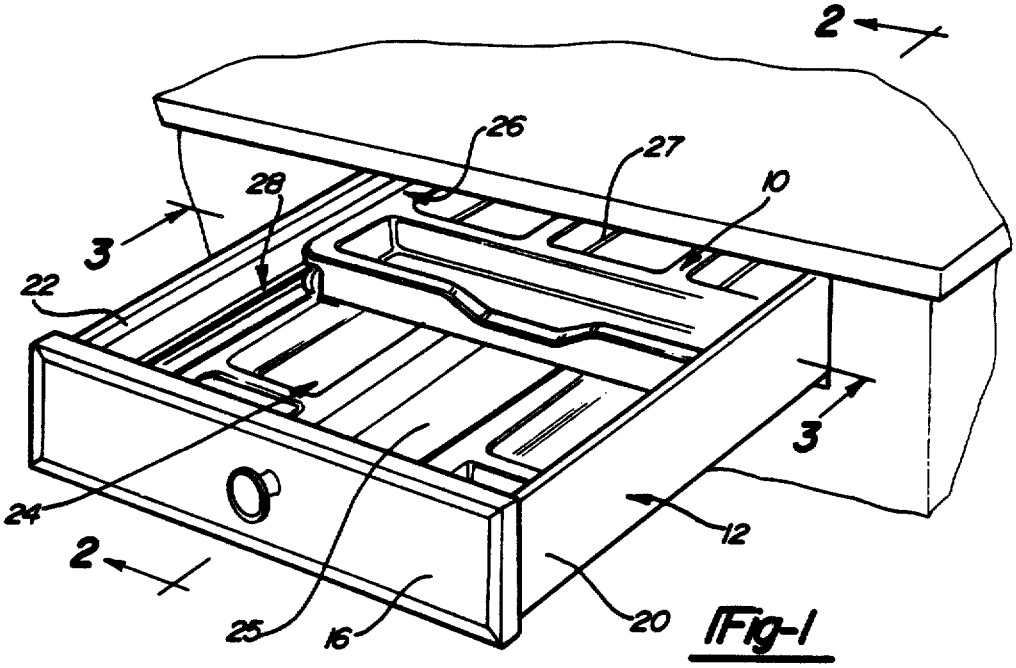
FIG. 1 is a perspective view of a drawer retrofitted with the storage apparatus of the present invention.

Referring now to FIG. 1, the storage apparatus 10 of the present invention is shown installed in a drawer 12. The drawer 12 is of conventional design having a bottom 14, front wall 16, rear wall 18 and right and left side walls 20 and 22. A base tray 24 having a compartmentalized storage section 25 is connected to an upper tray 26 defining a compartmentalized storage section 27 by a guide means generally indicated by the arrow 28.

The base tray 24 and upper tray 26 are preferably vacuum formed in one piece from a thermoplastic polymer such as polypropylene or polyvinylchloride. The guide means 28 are preferably roller track assemblies of the type normally used to mount a drawer in a cabinet. Right and left roller track assemblies 30 and 32 are better shown in FIGS. 2 and 3. They are preferably secured to the upper and base tray in a reverse orientation relative to the normal orientation of drawer roller track assemblies used to attach a drawer to a cabinet.

Figure 2:
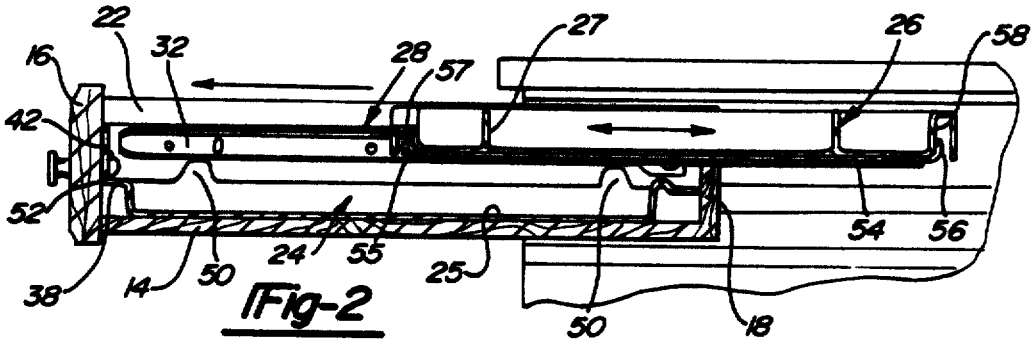
FIG. 2 is a cross-sectional view taken along the line 2—2 in FIG. 1.
Figure 3:
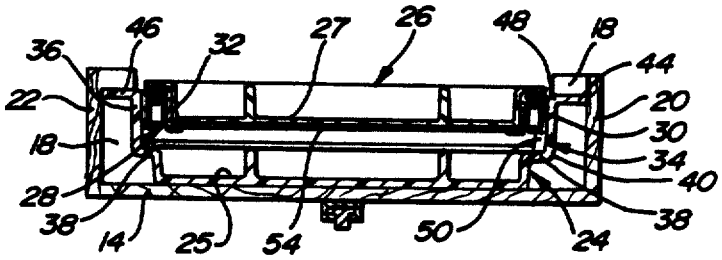
FIG. 3 is a cross-sectional view taken along the line 3—3 in FIG. 1.
Figure 4:
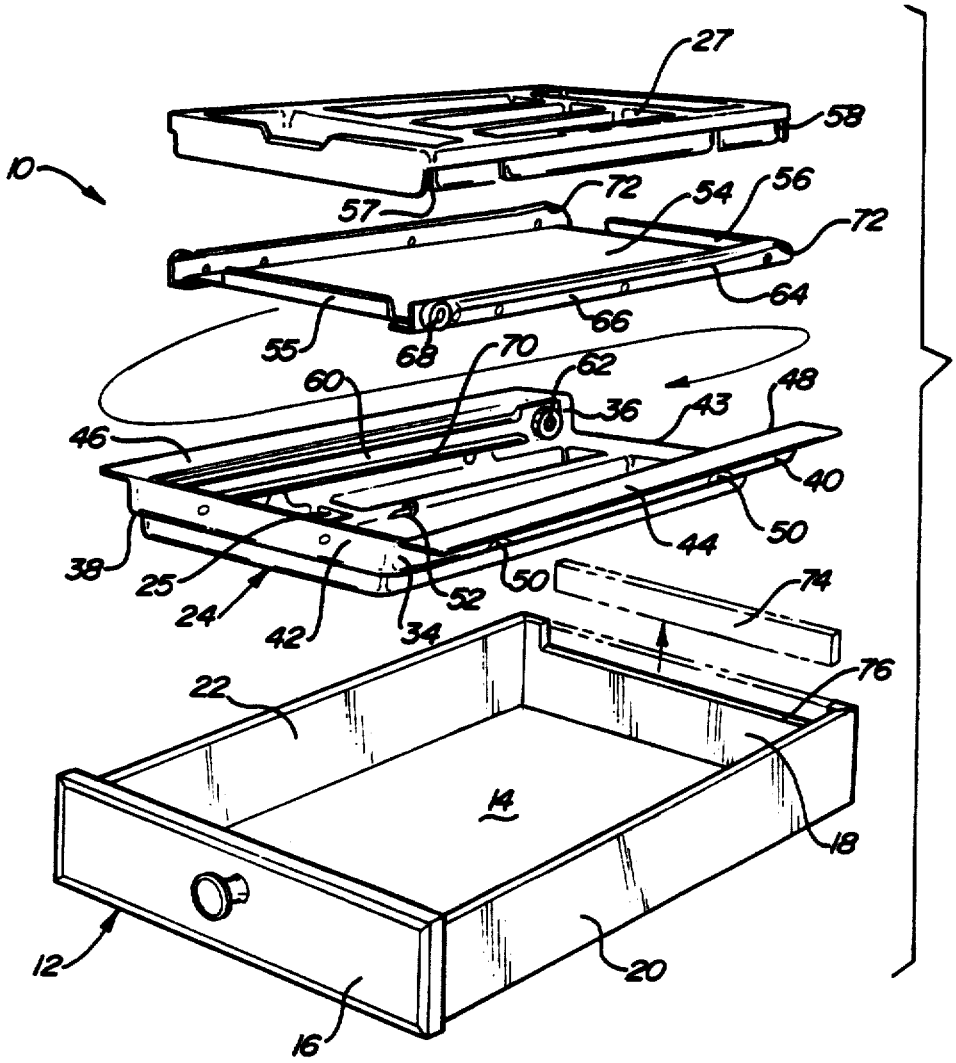
FIG. 4 is an exploded perspective view showing a modified drawer and the storage apparatus of the present invention.

Referring now to FIGS. 2 and 3, right and left roller track assemblies 30 and 32 are connected to a right and a left roller track mounting wall generally indicated by reference numerals 34 and 36 of the base tray 24. The mounting walls may be shaped in many different ways, however, the preferred shape is to provide a lip 38 extending horizontally from the lower compartmentalized storage section 25. The mounting walls 34 and 36 extend upwardly from the outer edge 40 of the lip 38. A front vertical wall 42 of the base tray 24 extends vertically upwardly from the lip 38 and is substantially parallel to the inside of the front wall 16. The rear edges of the mounting walls 34 and 36 and the rear edge of the lip 38 define an opening 43 through which the upper tray 26 is moved.

Right and left trim flanges 44 and 46 extend horizontally outwardly from the upper edge 48 of the right and left roller track mounting walls 34 and 36 which are secured to the right and left roller track mounting walls 34 and 36. Alternatively, the trim flanges 44 and 46 could have a downwardly extending wall (not shown) if it is desirable to provide a storage apparatus which is not cut to fit to the drawer sides. The roller track assemblies 30 and 32 are located vertically on the mounting walls 34 and 36 by seats 50 integrally molded into the mounting walls. The front vertical wall 42 is secured to the front wall 16 by means of fasteners 52. Alternatively, the base tray 24 could be glued or secured to the bottom 14 of the drawer 12. With either type of fastening means, it is important that the base tray 24 is held securely so that it does not move when the upper tray 26 is opened by the force of opening or the cantilever forces.

The upper tray 26 includes a detachable upper compartmentalized storage section 27 which is detachably secured to a support panel 54. The support panel 54 is a planar member having front and rear flanges 55 and 56 which are upwardly extending members that are received in front and rear recesses 57 and 58 of the compartmentalized storage section 27. The upper compartmentalized storage section is detachable from the support panel 54 so that it can be used as a tray or may be removed for cleaning. The detachable construction also simplifies molding and assembly processes required to manufacture the storage apparatus 10.

Base tray channels 60 form one-half of the roller track assemblies 30 and 32 and are secured to the right and left roller track mounting walls 34 and 36. The base tray channels 60 include a bearing member 62 disposed at the rear end thereof. A roller engaging surface 64 is formed on upper tray channels 66 at the upper edge thereof. The upper tray channels 66 are secured to opposite lateral sides of the support panel 54. Upper tray channels are preferably L-shaped to permit attachment to the planar surface of the support panel 54. The upper tray channels 66 include bearing members 68 at the front end thereof which ride upon roller engaging surface 70 formed at the lower end of the base tray channels 60.

A raised portion 72 formed on the rear end of each upper tray channel 66 biases the upper tray 26 into its forward position when the drawer 12 is opened. The raised portion 72 lowers the rear end of the upper tray 26 slightly when the upper tray 26 is in its closed position. When it is desirable to shift the upper tray 26 into its open position in which it is cantilevered rearwardly from the base tray 24, the roller engaging surface 64 is rolled up over the bearing member 62 to lift the rear end of the upper tray slightly.

To allow for rearward shifting of the upper tray 26, a cutout 74 is removed from the rear wall 18 to form an opening 76 through which the upper tray 26 may partially pass to provide access to the base tray 24.

The method of the present invention is one which is simplified so that only readily available household tools are required for assembly. The drawer 16 is modified by the removal of the cutout 74 to form the opening 76 in the rear wall 18. No other structural modification must be made in the drawer and the removal of the cutout 72 may be accomplished by a power or hand saw. The base tray can then be fitted to the drawer by trimming the trim flanges 44 and 46 to the space provided between right and left side walls 20 and 22. Right and left trim flanges 44 and 46 are easily cut by a hand or with a power saw after marking to the interior dimension of the drawer.

The base tray 24 is then inserted into the drawer 12 and fastened by fasteners 52 which secure the front vertical wall 42 of the base tray to the front wall 16 of the drawer 12. The upper tray 26 is installed by inserting the bearing member 68 of the upper tray channel 66 into the base tray channel 60. The detachable upper compartmentalized storage section 27 is then placed on the support panel 54 with the front and rear flanges 55 and 56 being received in the front and rear recesses 57 and 58. Some interference fit is desirable between the front and rear flanges and the front and rear recesses so that the upper compartmentalized storage section is firmly secured to the support panel 54.

The preceding description of the present invention is of a preferred embodiment and is not to be construed in a limiting sense. Many modifications may be made in the structure of the invention without departing from the spirit and scope of the present invention as claimed in the following claims.

I claim:

1. A storage apparatus for a drawer, the drawer having a bottom, a front wall, a rear wall and two side walls, said rear wall having an opening in an upper portion thereof, said storage apparatus comprising:

a base tray having means for fixedly securing said base tray to the drawer, said base tray having a rear wall with an opening therein and in cooperative alignment with the opening in the rear wall of said drawer, said base tray also having a compartmentalized storage section, a vertically extending front lip means for abutting the drawer front wall and a pair of right and left trimmable flange means for extending from the compartmentalized storage section to the drawer side to enable the base tray to be adapted to fit within side walls of drawers of various widths;

an upper tray disposed above said base tray;

guide means interconnecting said upper tray to said base tray for guiding limited relative horizontal movement therebetween enabling said upper tray to move from a closed position disposed above said base tray to an open position wherein said upper tray is cantilevered rearwardly and extending horizontally through both the opening in the drawer rear wall and the opening in said base tray to positions partially behind the rear wall of the drawer and the rear wall of said base tray providing access to said base tray.

2. In the storage apparatus of claim 1, said guide means further comprising right and left roller track mounting surfaces adjacent right and left sides of said compartmentalized storage section, said right and left trimmable flange means extending substantially horizontally and outwardly from said right and left roller track mounting surfaces.

3. The storage apparatus of claim 2 wherein said right and left trimmable flange means are cut to fit closely between the two side walls.

4. The storage apparatus of claim 1 wherein said securing means includes means on said vertically extending front lip means for securing said front lip means to the front wall of said drawer.

5. The storage apparatus of claim 1 wherein said guide means comprises a roller and track assembly connected to two adjacent portions of said upper tray and said base tray.

6. The storage apparatus of claim 5 wherein said upper tray has a support panel, said guide means having right and left roller track channels extending from front to rear on lateral sides of the support panel, and a compartmentalized storage receptacle detachably secured to said support panel.

7. The storage apparatus of claim 5 wherein a pair of roller and track assemblies are provided, said roller and track assemblies each further comprising:

a pair of base tray channels secured to said base tray with one on each lateral side of the base tray, each of said base tray channels having a first bearing member at one end;

a pair of upper tray channels secured to said upper tray with one on each lateral side of the upper tray, each of said upper tray channels having a second bearing member at an opposite end from said one end of the base tray channel; and said first bearing members each rolling against a first roller engaging surface of said upper tray channels and said second bearing members each rolling against a second roller engaging surface of said base tray channels.

8. The storage apparatus of claim 7 wherein said first roller engaging surfaces have slightly raised curved sections at an end of said track opposite the second bearing members, said curved sections being effective to bias said upper tray into the closed position when the drawer is initially opened because an end of the upper tray disposed over said first bearing members must raise slightly for said track to pass by the first bearing members.

9. The storage apparatus of claim 1 wherein said base and upper trays are each one-piece molded members.

10. A two-tiered storage apparatus for a drawer, said drawer having a bottom panel, a front wall, a rear wall having an opening and two side walls, said storage apparatus comprising:

a base tray having a compartmentalized storage section, a lip means for extending substantially horizontally and outwardly from said compartmentalized storage section toward said front wall and said two side walls, said lip means having an outer edge spaced from said compartmentalized storage section, a vertical wall extending upwardly from said outer edge of said lip, said vertical wall having an opening in the rear of said base tray in cooperative alignment with the opening in the rear wall of said drawer, lateral trim flanges connected to an upper edge of said vertical wall and extending substantially horizontally and outwardly from said vertical wall each toward one of said two side walls, said base tray having means for fastening said base tray to said drawer;

an upper tray disposed above said base tray, said upper tray having a support panel and a compartmentalized storage receptacle detachably secured to said support panel; and roller track means connected to said upper tray and said base tray for guiding horizontal shifting of said upper tray from a closed position wherein said upper tray is vertically directly above said base tray to an open position wherein said upper tray is cantilevered by said roller track means rearwardly and above said base tray to extend horizontally through said opening in the rear of said base tray and the opening in said rear wall of said drawer.

11. The storage apparatus of claim 10 wherein said fastening means includes means on said vertical wall for securing said vertical wall to the front wall of said drawer.

12. The storage apparatus of claim 10 wherein said roller track means comprises a roller and track assembly connected to adjacent portions of said upper tray and said base tray.

13. The storage apparatus of claim 12 wherein a pair of roller and track assemblies are provided, said roller and track assemblies each further comprising:

a pair of base tray channels secured to said base tray with one on each lateral side of said base tray, each of said base tray channels having a first bearing member at one end;

a pair of upper tray channels secured to said upper tray with one on each lateral side of said upper tray, each of said upper tray channels having a second bearing member at an opposite end from said one end of said base tray channel; and said first bearing members each rolling on a first roller engaging surface of said upper tray channels and said second bearing members each rolling on a second roller engaging surface of said base tray channels.

14. The storage apparatus of claim 13 wherein said first roller engaging surfaces have a slightly raised curved sections at the end of said track opposite the second bearing members, said curved sections being effective to urge said upper tray into the closed position when the drawer is initially opened because an end of the upper tray disposed over said first bearing members must raise slightly for said track to pass by the first bearing members.

* * * * *